US006834665B2

(12) United States Patent
Kewish et al.

(10) Patent No.: US 6,834,665 B2
(45) Date of Patent: Dec. 28, 2004

(54) AUTOMATIC ADJUSTABLE TRAP PRIMING VALVE

(76) Inventors: Edwin Kewish, 6267 Shadow Lake Dr., Pinston, AL (US) 35126; Fred J Kewish, III, 2165 Mountain View Rd., Birmingham, AL (US) 35120

( * ) Notice: Subject to any disclaimer, the term of this patent is extended or adjusted under 35 U.S.C. 154(b) by 153 days.

(21) Appl. No.: 10/350,100

(22) Filed: Jan. 24, 2003

(65) Prior Publication Data

US 2004/0144425 A1 Jul. 29, 2004

(51) Int. Cl.[7] ..... E03C 1/296
(52) U.S. Cl. ..... 137/247.25; 137/118.05
(58) Field of Search ..... 137/118.04, 118.05, 137/247.25

(56) References Cited

U.S. PATENT DOCUMENTS 653,437 A * 7/1900 Burger et al. ..... 137/247.25
815,691 A * 3/1906 Ericsson ..... 137/118.05
1,185,041 A * 5/1916 Ashey ..... 137/118.04
1,464,244 A * 8/1923 Drake ..... 137/118.04
1,759,826 A 5/1930 Goss
1,967,643 A * 7/1934 Williams ..... 137/118.05
1,967,645 A * 7/1934 Williams ..... 137/118.05
1,985,647 A * 12/1934 Smith ..... 137/118.05
3,146,787 A * 9/1964 Kupfer, Jr. ..... 137/118.05
4,574,399 A * 3/1986 Sullivan ..... 137/247.25
5,263,508 A * 11/1993 Perrott ..... 137/247.25

* cited by examiner

*Primary Examiner*—John Rivell
(74) *Attorney, Agent, or Firm*—Dykema Gossett PLLC

(57) ABSTRACT

An automatic adjustable trap priming valve includes a housing through which inlet water to a frequently used plumbing fixture flows; a diverter member which extends across the housing, the diverter member providing an interior passageway which communicates with a delivery line leading to a floor drain trap and a side opening which communicates with the interior passageway, the opening facing a downstream side of the diverter member; a needle valve in the interior passageway for adjusting the flow of water through the opening to the interior passageway in the diverter member and to the delivery line, and a flap for opening and closing the diverter member opening.

4 Claims, 1 Drawing Sheet

NTS 10
13
25
11
26
14
18
15
19
17
50
20
21
16
51
16b
16a
12
NTS 45
50a
36
35
10
40
30
CW
50
55
61
60
64
62
63

AUTOMATIC ADJUSTABLE TRAP PRIMING VALVE

BACKGROUND OF THE INVENTION

1. Field of the Invention

The present invention relates to an automatic adjustable trap priming valve which is placed in an inlet water line to a frequently used plumbing fixture for diverting a flow of water passing through the inlet water line to a floor drain trap.

2. The Prior Art

Drain openings are often located in floors of wash rooms, laundry rooms, laboratories, etc., to drain liquids which may spill onto the floor from, e.g., nearby sinks. These drain holes are connected to sewer systems via "P" traps, the "P" traps containing water to prevent backflow of sewer odors.

However, the water in the traps will evaporate over time, and if no replacement water is caused to flow through the drain openings, sewer odor will flow into the area above the drain opening. This is highly undesirable.

A known technique for addressing this problem is to place a trap priming valve in a water inlet of a frequently used plumbing fixture and to connect the trap priming valve to the trap, so that whenever the fixture is used and inlet water is caused to flow through the inlet line, a portion will flow to the trap to replenish evaporated water therein and prevent sewer backup odors.

However, known trap valves are complicated in structure and not easily adjusted, i.e., in order to control the amount of water flow to the trap when the sink is used. See, for example, U.S. Pat. No. 1,759,826.

The present invention is directed to an improved trap priming valve which is simple in contraction and easily adjusted.

SUMMARY OF THE INVENTION

According to this invention, an automatic adjustable trap priming valve includes a housing through which inlet water flows, a diverter element which extends across the housing and is connected at a first end to a delivery line extending to the trap, the diverter element providing an interior passageway and an annular seat facing the downstream (upward) direction of water flow, the annular seat defining an opening which communicates with the passageway, and a flap which is pivotally connected to the housing to be lifted off the seat with water flowing through the housing and to fall down onto the seat when the flow of water ceases. A control member is associated with the second end of the diverter element to control the water flow area between the opening and the passageway, and thus control the flow of inlet water into the passageway (and to the trap) when inlet water flows through the housing and lifts the flap element off the seat.

The present invention will be better understood by reference to the attached drawings, taken in conjunction with the following discussion.

DETAILED DESCRIPTION OF THE PREFERRED EMBODIMENT

Figure 1:
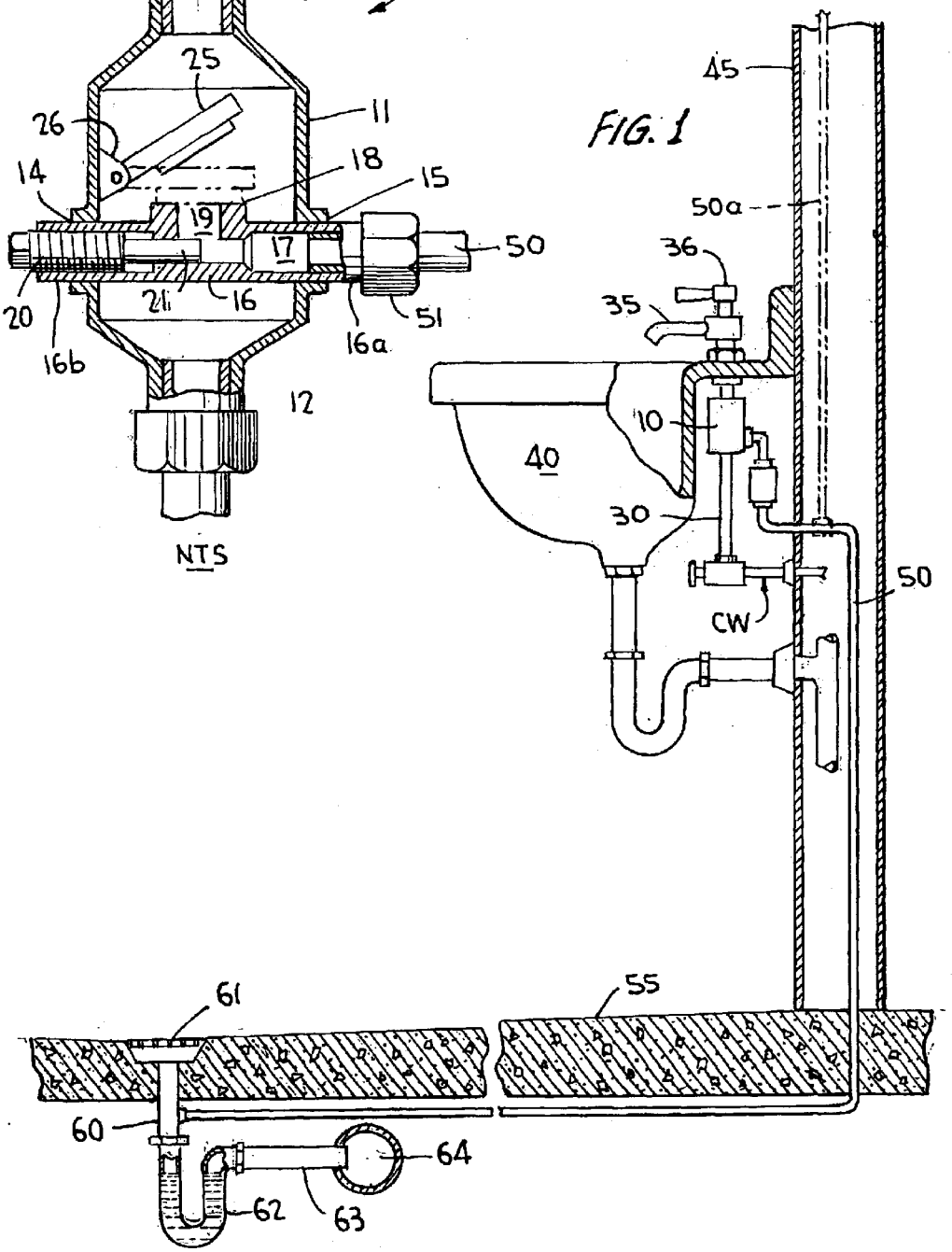
FIG. 1 shows a side view of a sink mounted on a wall, a floor with a drain opening and trap below the drain opening, the location of the inventive trap priming valve in the inlet water line which communicates with a faucet mounted on the frequently used plumbing fixture, and the delivery line which conveys inlet water diverted by the trap priming valve to the trap.

FIG. 1 shows the inventive trap priming valve 10 positioned in a cold water intake line 30 that leads to a fixture faucet 35 mounted on a sink 40, which is itself mounted on a wall 45. A delivery line 50 extends from a side of the trap priming valve 10 into the wall 45 and down through the floor 55 and laterally over to a drain pipe 60 that extends downwardly from a floor drain opening 61 in the floor 55 and to a P-pipe (trap) 62, which is connected to an outlet pipe 63 that extends to a sewer line 64. The trap priming valve 10 operates to divert a flow of inlet water to the delivery line 50 or 50*a* to replenish the liquid in the trap 62 whenever the cold water faucet 35 is opened by a user, causing water to flow through intake line 30.

Figure 2:
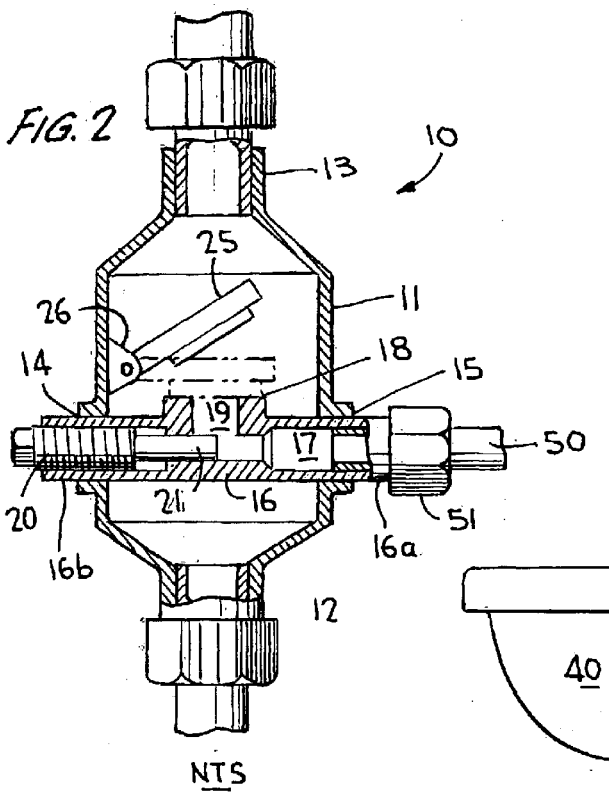
FIG. 2 shows a sectional side view of the inventive trap priming valve as indicated in FIG. 1.

FIG. 2 shows the preferred embodiment of trap priming valve 10 placed in the cold water intake line 30 of FIG. 1. The trap valve includes a housing 11 having an inlet with externally-threaded inlet flange 12 at one end and an outlet with externally-threaded outlet flange 13 at its opposite end, and aligned openings 14 and 15 along its sides. A generally tubular diverter member 16 extends through the housing so that a first end 16*a* sealingly extends through opening 15 and a second end 16*b* sealingly extends through opening 14. The diverter member provides an interior passageway 17, and it defines an annular seat 18 on an upper surface thereof around an opening 19 that communicates with the passageway 17. The first end 16*a* is externally threaded to enable delivery line 50 to be sealingly connected thereto using a nut 51. The second end 16*b* is internally threaded to sealingly contain a valve pin 20 which can be rotated to adjust the positioning of its end 21 within the passageway 17 and thus the flow area between opening 19 and passageway 17. A flap element 25 rotatably mounted on the housing 11 by brackets 26 is movable against annular seat 18 to prevent flow of water into the diverter member 16 (phantom positioning in FIG. 2) or away from the annular seat to enable such flow (solid line positioning in FIG. 2).

In operation, when a user turns on the cold water intake line 30 by turning knob 36 of faucet fixture 35, cold water will flow upwardly into the trap valve 10 through first inlet flange 12, through housing 11 and out the inlet flange 13. Due to this cold water flow, the flap element 25 will rotate upwardly around the brackets 26, thereby enabling a flow of cold water through opening 19 and into passageway 17, and from there through delivery line 50 or 50*a* to the trap 62 to replenish the water contained therein. Adjustment of valve pin 20 will control the amount of water that can flow through the opening 14 into the passageway 17 per unit of time.

Although a preferred embodiment of trap valve has now been shown and described, modifications therein can be made and still fall within the scope of the appended claims. For example, the trap need not be located in the floor immediately beneath the trap valve, but can be located in a lower or higher floor within a building. Water can flow through line 50*a* to a floor drain trap located on a floor above the frequently used plumbing fixture. Also the water flow through 50 or 50*a* can be routed through a simple distribution header—to deliver water to multiple floor drain traps.

We claim:

1. A trap priming valve which can divert a portion of water flowing there through to a floor drain trap, said trap priming valve comprising a housing defining an inlet with an inlet flange, and outlet with an outlet flange, and aligned openings on opposite sides thereof, a diverter member which extends through said housing and defines a first end that sealingly extends through said first side opening and a second end which extends through said second side opening, said diverter member defining an interior passageway and an external annular seat around an opening that communicates with said interior passageway, said first end being connectable to a delivery line to a floor drain trap, a control member associated with said second end to adjust flow of water from said opening to said passageway; and a flap element which is connected to said housing to rotate toward and away from said annular seat based on water flowing through said housing to block or unblock said seat.

2. A trap priming valve according to claim 1, wherein said first end of said diverter member is externally threaded for connection to a connection nut at an end of a delivery line.

3. A trap priming valve according to claim 1, wherein said second end of said diverter member is internally threaded, and said control member comprises a needle valve threadingly inserted in said first end of said diverter member.

4. A combination of a trap beneath a floor, a sink with water inlet line, a trap priming valve in said water inlet line, and a delivery line for delivering inlet water from said inlet line to said trap, said trap priming valve comprising:

a housing defining an inlet with an inlet flange, and outlet with an outlet flange, and aligned openings on opposite sides thereof, a diverter member which extends through said housing and defines a first end that sealingly extends through said first side opening and a second end which extends through said second side opening, said diverter member defining an interior passageway and an external annular seat around an opening that communicates with said interior passageway, said first end being connectable to a delivery line to a floor drain trap, a control member associated with said second end to adjust flow of water from said opening to said passageway; and a flap element which is connected to said housing to rotate toward and away from said annular seat based on water flowing through said housing to block or unblock said seat.

* * * * *